US006439988B1

(12) United States Patent
Long et al.

(10) Patent No.: US 6,439,988 B1
(45) Date of Patent: Aug. 27, 2002

(54) CORNER SANDING TOOL

(75) Inventors: David J. Long, Shrewsbury, MA (US); Paul A. Krupa, Grand Island; David J. Mansfield, West Seneca, both of NY (US)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 0 days.

(21) Appl. No.: 09/399,418

(22) Filed: Sep. 20, 1999

(51) Int. Cl.[7] ..... B24D 17/00

(52) U.S. Cl. ..... 451/495; 451/502; 451/523; 451/524

(58) Field of Search ..... 451/495, 502, 451/523, 524

(56) References Cited

U.S. PATENT DOCUMENTS 2,112,593 A * 3/1938 Campbell
3,707,059 A * 12/1972 Burtch et al.
3,998,012 A * 12/1976 Ness
5,168,672 A * 12/1992 Gregoire, Sr.
5,337,523 A * 8/1994 Walsh
5,662,519 A * 9/1997 Arnold

* cited by examiner

*Primary Examiner*—Joseph J. Hail, III
*Assistant Examiner*—Willie Berry, Jr.
(74) *Attorney, Agent, or Firm*—David Bennett

(57) ABSTRACT

Sanding tools made from a block of a foamed polymer sponge having two contiguous sides meeting at a right angle that are provided with an abrasive coating and which have in addition a means for grasping the tool formed in the body of the sponge so that the user can simultaneously sand two walls meeting to form a corner.

4 Claims, 2 Drawing Sheets

CORNER SANDING TOOL

BACKGROUND OF THE INVENTION

This invention relates to tools that are useful for sanding corners in rooms that have been roughed out with drywall materials and optionally plaster to cover joints between the drywall materials. It can also be used however in any situation in which a comer needs to be sanded. In the context of this invention, a corner is located wherever two planar surfaces meet at an angle that is at least approximately a right angle. Thus it covers joints between the walls but also joints between a wall and a floor or ceiling.

Before a finish such as a layer of paint or wallpaper can be applied to a rough surface, it is necessary to sand the surface down until a smooth surface is created to receive the finish. In the past this has been done manually or using a wooden block with sandpaper wrapped around the block. This is not only rough on the hands but it is difficult to get a uniform sanding operation without damage to knuckles and fingers. In addition uniformity of pressure and sanding is difficult to maintain in these circumstances. The present invention provides a convenient way to perform the sanding operation in a uniform and controlled fashion.

DESCRIPTION OF THE INVENTION

The present invention provides a sanding tool comprising a compressible sponge having first and second planar surfaces meeting at a right angle, said surfaces being coated with an abrasive material in at least the area of the surfaces adjacent the right angle and, in the portion of the sponge enclosed between the first and second surfaces, a grasping means forming an integral portion of the sponge.

The abrasive material preferably covers all of each of the first and second planar surfaces and can be provided by abrasive materials adhered directly to the sponge. It is preferred however that the abrasive material is provided by sandpaper adhered to the surfaces by means of a glue.

The sponge is also provided with grasping means which can take the form of holes cut into the sponge to accommodate the fingers of the user. Alternatively and often preferably the sponge may be formed into a handle adapted to be grasped by the user. In its simplest form this handle can have the shape of a pair of parallel grooves each adapted to accommodate the fingers or the thumb of the user. In this embodiment the indentations preferably have the forms of first and second grooves equidistant from first and second planar surfaces respectively and each parallel to the other groove and to its adjacent surface, such that the first and second grooves together define a portion of the sponge adapted to be grasped by the user with the fingers and thumb located in the grooves.

Thus in cross-section the preferred tool has the appearance of an arrowhead, preferably along the full length of the tool.

The material from which the sponge is formed is preferably a resilient open-celled foam of a polymer such as a polyurethane but foams of other polymers such as polyethylene or a plasticized PVC can be used if desired.

The foam should be deformable but highly resilient such that it regains its shape after any deforming pressure has been removed and retains this shape after a plurality of deformations.

DESCRIPTION OF PREFERRED EMBODIMENTS

Figure 1:
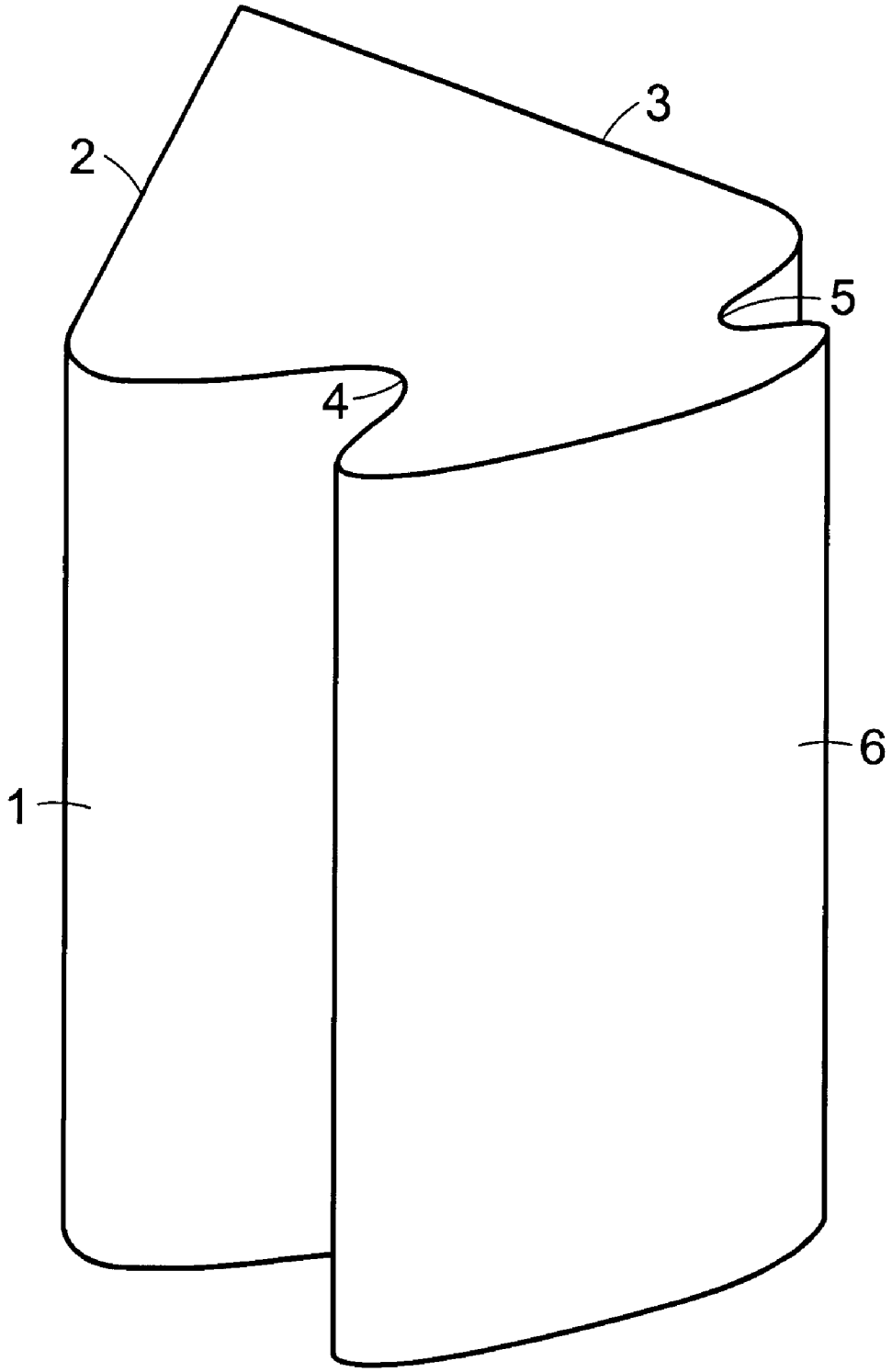
FIG. 1 is an elevation of a tool according to the invention.
Figure 2:
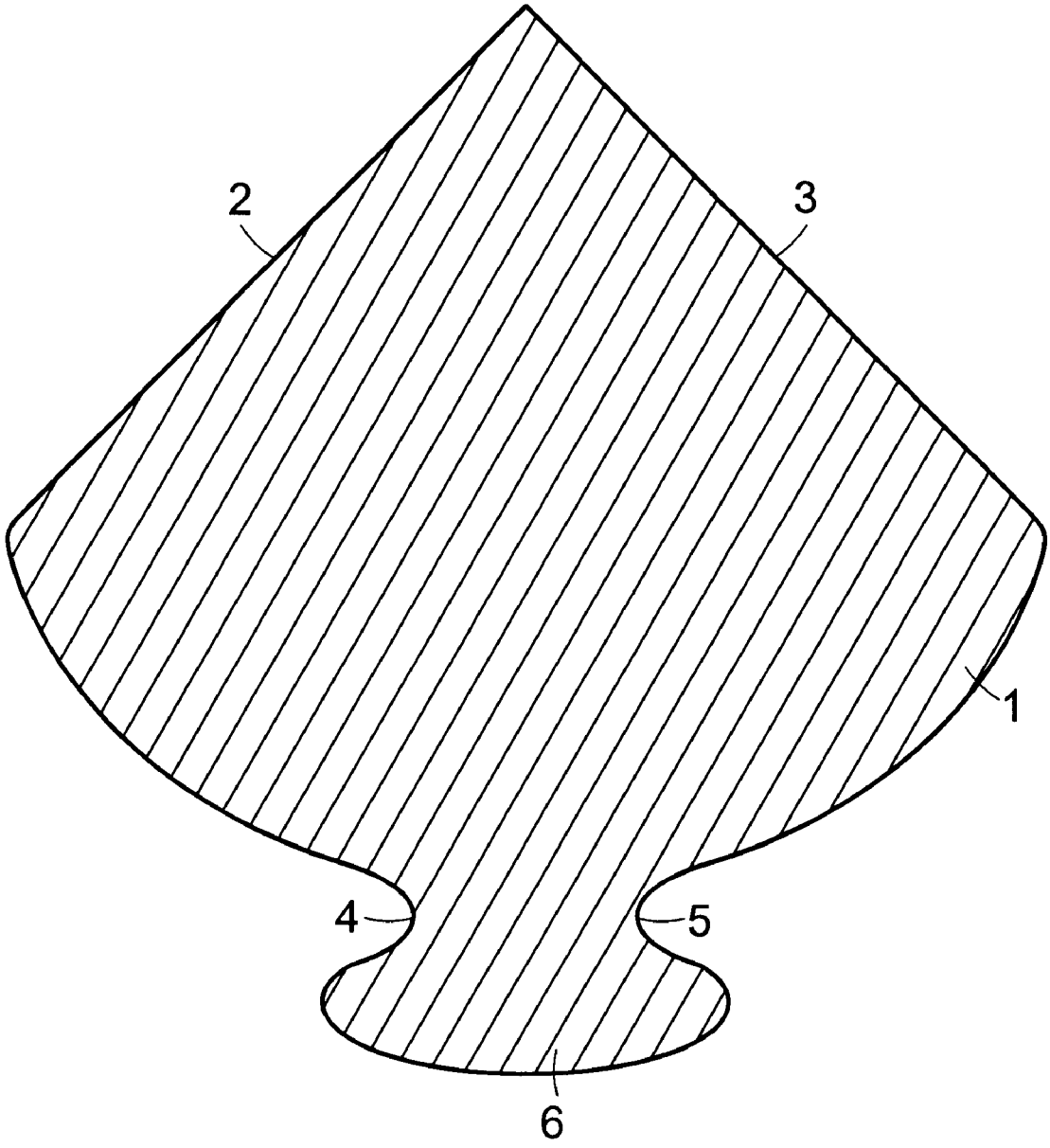
FIG. 2 is a cross-section of the tool showed in FIG. 1.

The invention is now described with particular reference to the preferred embodiments shown in the FIGS. 1 and 2 which are not intended to imply any essential limitations on the scope of the invention.

In the Drawings a sponge provided by a foamed open-celled polyurethane polymer body member, 1, having first and second planar surfaces, 2 and 3, covered with sandpaper and meeting in a right angle. The portion of the sponge within the space defined by the first and second planar surfaces is provided with first and second grooves, 4 and 5, defining a handle, 6, projecting between the grooves and affording means to grasp the sponge with a hand.

What is claimed is:

1. A sanding tool comprising a compressible sponge formed from an open-celled foamed polyurethane, said sponge having first and second planar surfaces meeting at a right angle, said surfaces being coated with an abrasive material in at least the area of the surfaces adjacent the right angle and, in the portion of the sponge enclosed between the first and second surfaces, a grasping means forming an integral portion of the sponge.

2. A sanding tool according to claim 1 in which the first and second planar surfaces are coated with sandpaper.

3. A sanding tool according to claim 1 in which the grasping means are provided by indentations formed in the body of the sponge.

4. A sanding tool according to claim 3 in which the indentations have the forms of first and second grooves equidistant from first and second planar surfaces respectively and each parallel to the other groove and to its adjacent surface, wherein the first and second grooves together define a portion of the sponge adapted to be grasped by the user with the fingers and thumb located in the grooves.

* * * * *